US012723475B2

(12) United States Patent
Millican et al.

(10) Patent No.: US 12,723,475 B2
(45) Date of Patent: Sep. 1, 2026

(54) TUBULAR HANDLING APPARATUS AND METHODS

(71) Applicant: Helmerich & Payne, Inc., Tulsa, OK (US)

(72) Inventors: Patrick Millican, Sapulpa, OK (US); Jerry Ray Prescott, Jr., Tulsa, OK (US); Bart Draeger, Broken Arrow, OK (US)

(73) Assignee: Helmerich & Payne, Inc., Tulsa, OK (US)

( * ) Notice: Subject to any disclaimer, the term of this patent is extended or adjusted under 35 U.S.C. 154(b) by 151 days.

(21) Appl. No.: 18/891,601

(22) Filed: Sep. 20, 2024

(65) Prior Publication Data

US 2025/0092744 A1 Mar. 20, 2025

Related U.S. Application Data

(60) Provisional application No. 63/583,997, filed on Sep. 20, 2023.

(51) Int. Cl.
*E21B 19/15* (2006.01)

(52) U.S. Cl.
CPC ..... *E21B 19/15* (2013.01)

(58) Field of Classification Search
None
See application file for complete search history.

(56) References Cited

U.S. PATENT DOCUMENTS

| | | | | |
|---|---|---|---|---|
| 2,751,781 | A * | 6/1956 | McConnell | G01M 3/2846 414/746.4 |
| 3,306,472 | A * | 2/1967 | Blanz | B65G 47/29 221/241 |
| 4,462,749 | A * | 7/1984 | Crocker | E21B 19/155 414/745.9 |
| 5,769,597 | A * | 6/1998 | Tsune | B65G 47/8838 414/746.1 |
| 8,113,762 | B2 * | 2/2012 | Belik | E21B 19/15 414/746.4 |
| 11,454,069 | B2 * | 9/2022 | Tambs | E21B 19/164 |
| 2006/0045655 | A1 * | 3/2006 | Wells | E21B 19/155 414/22.61 |
| 2007/0031215 | A1 * | 2/2007 | Belik | E21B 19/155 414/22.62 |
| 2015/0047904 | A1 * | 2/2015 | Sharpe | E21B 7/046 175/52 |
| 2019/0345782 | A1 * | 11/2019 | Porter | E21B 19/15 |

* cited by examiner

*Primary Examiner* — Kipp C Wallace
(74) *Attorney, Agent, or Firm* — Kilpatrick Townsend & Stockton LLP

(57) ABSTRACT

A tubular handling apparatus includes a plurality of pipe beams defining a pipe rack, a plurality of tiering arms, each having a first recess, and a plurality of lifting arms. Each lifting arm corresponds to one of the plurality of tiering arms and each lifting arm includes a second recess proximate a first end of each of the lifting arms. Each second recess is aligned with a first recess of a corresponding tiering arm. The plurality of lifting arms are actuatable between a raised position and a lowered position relative to the plurality of tiering arms. A top surface of each of the plurality of pipe beams includes a slope extending downward towards the plurality of tiering arms. As the lifting arms raise, the tubular is lifted from the tiering arms and rolls along the top edge of the lifting arms until the tubular engages with the second recess.

31 Claims, 13 Drawing Sheets

TUBULAR HANDLING APPARATUS AND METHODS

CROSS-REFERENCES TO RELATED APPLICATIONS

This application claims the benefit of priority to U.S. Provisional Patent Application No. 63/583,997, filed Sep. 20, 2023, and entitled "Tubular Handling Apparatus And Methods," the contents of which are hereby incorporated by reference in its entirety for all purposes.

BACKGROUND

Tubulars at a drilling site may be delivered from a storage location (e.g., a pipe rack) to a hydraulic catwalk or the like. For example, it may be desirable to move tubulars to an elongated and elevated platform of a drilling rig where the tubulars are laid out and lifted into the derrick or to another location on the drilling rig. Tubulars are often moved via a crew of workers using a variety of tools and procedures to manually roll tubulars onto various surfaces. Handling tubulars is very labor intensive and is a high risk for resulting in injuries to workers. A large portion of accidents on drilling rigs are associated with the handling of tubulars due to their weight and size. For example, tubulars may roll when a worker is not facing the tubular and the worker may be struck in the body, including but not limited to the head, by the tubular. Given the size and weight of tubulars, such injuries can be serious.

SUMMARY

This disclosure relates to improved methods and systems for moving tubulars of a drilling rig. Many of the methods and systems described herein will be beneficial for increasing safety and efficiency of drilling rig operations. Various features of such methods and systems are described herein.

According to one embodiment, a tubular handling apparatus includes a plurality of pipe beams defining a pipe rack, a plurality of tiering arms, each having a first recess, and a plurality of lifting arms. Each lifting arm corresponds to one of the plurality of tiering arms and each lifting arm includes a second recess proximate a first end of each of the lifting arms. Each second recess is aligned with a first recess of a corresponding tiering arm. The plurality of lifting arms are actuatable between a raised position and a lowered position relative to the plurality of tiering arms. A top surface of each of the plurality of pipe beams includes a slope extending downward towards the plurality of tiering arms.

The apparatus may include various optional embodiments. A plurality of pipe sizers may be movable and adapted to accommodate a plurality of tubular sizes. Each lifting arm of the plurality of lifting arms may include a third recess proximate a second end of the lifting arm. Each lifting arm of the plurality of lifting arms may include an angled rear end region adapted to block a tubular from rolling off the rear end region. The apparatus may include a plurality of rollers positioned within the tiering arms for engaging with and moving a tubular positioned within the first recess of the tiering arms. At least one hydraulic cylinder may be coupled to the plurality of lifting arms for actuating the lifting arms from their respective lowered positions to their respective raised positions. A stopper plate having a moving block may be coupled to at least one spring and the moving block may be movable within a slot in a housing plate and adapted to block a tubular from rolling beneath the tiering arm. The plurality of tiering arms may be actuatable between an elevated position and a lowered position. The apparatus may be adapted to be placed adjacent or near to a pipe delivery system for a drilling rig, wherein the pipe delivery system comprises a trough and the apparatus is adapted to lift a tubular from a first position resting on the plurality of pipe beams or one or more tubulars resting on the plurality of pipe beams to a second position, from which the tubular rolls into the trough of the pipe delivery system. control system for controlling movement of the tiering arms and/or the lifting arms. The apparatus may further include a system is adapted to move the tiering and/or the lifting arms in response to a user command therefor. The control system may be coupled to a user control device by a wired or wireless coupling.

According to another embodiment, a method of moving a tubular, includes providing a tubular handling apparatus including a plurality of pipe beams defining a pipe rack, a plurality of tiering arms each having a first recess, and a plurality of lifting arms each having a second recess proximate a first end of each of the lifting arms. The plurality of lifting arms are actuatable between a raised position and a lowered position. The method further includes positioning a top edge of the tiering arms generally level with a bottom surface of a tubular on the pipe rack such that a tubular may roll from the pipe rack onto the tiering arms and raising the lifting arms from the lowered position below the tubular upwards to the raised position. As the lifting arms raise, the tubular is lifted from the tiering arms and rolls along the top edge of the lifting arms until the tubular engages with the second recess in the lifting arms. The method further includes lowering the lifting arms from the raised position to the lowered position where the tubular engages with the first recess in the tiering arms when the lifting arms are in their lowered positioned such that they no longer contact the tubular.

The method may include various optional embodiments. The method may include actuating a plurality of rollers on the tubular handling apparatus for moving the tubular in a longitudinal direction. The tubular handling apparatus may further include a plurality of pipe sizers, and the step of raising the lifting arms from a lowered position below the tubular upwards to a raised position may include lifting the tubular over the pipe sizers. The step of lowering the lifting arms from the raised position to the lowered position may include lowering a top edge of the lifting arms below a bottom surface of a second tubular such that the second tubular rolls onto the tiering arm and engages with the pipe sizers.

According to another embodiment, a pipe handling system includes a pipe delivery system includes a trough adapted for receiving a tubular and a plurality of pipe movement systems. Each of the plurality of pipe movement systems located adjacent or proximal the pipe delivery system. Each of the pipe movement systems includes a means for storing a plurality of tubulars, a means for lifting one of the plurality of tubulars from the means for storing a plurality of tubulars to a first position, and a means for moving the one of the plurality of tubulars located in the first position longitudinally. The means for lifting one of the plurality of tubulars may be adapted to move the one of the plurality of tubulars from the first position to a second position from which the tubular will roll into the trough.

The pipe handling system may include various optional embodiments. The means for storing the plurality of tubulars may include a plurality of beams extending outwardly from the pipe delivery system. The means for lifting one of the plurality of tubulars may include a plurality of lifting arms adapted to move from a first position to a second position in response to a user command therefor. The means for moving the one of the plurality of tubulars longitudinally comprises a plurality of rollers adapted to rotate while the one of the plurality of tubulars is resting thereon.

According to another embodiment, a method of drilling a well includes (a) providing a trough for receiving a drill pipe therein and moving the pipe from the trough to a location above a rig floor of a drilling rig coupled to a drill string and drilling a well, (b) providing a pipe rack having a plurality of drill pipes thereon, (c) providing a pipe handling apparatus adjacent or proximal to the pipe rack, wherein the pipe handling apparatus comprises means for receiving a pipe from the pipe rack and lifting the pipe to move the pipe to the trough, (d) using the pipe handling assembly to move a first pipe from the pipe rack to the trough, (e) moving the pipe from the trough to the location above the right floor, (f) adding the pipe to the drill string, and (g) repeating steps (d)-(f) a plurality of times during drilling of the well.

DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

DETAILED DESCRIPTION

At a drilling site, a tubular may be delivered from a storage location (e.g., a pipe rack) to a hydraulic catwalk. The hydraulic catwalk may include a plurality of indexing arms that then lift the tubular onto a top surface of the hydraulic catwalk where the tubular is laid out and ultimately lifted to the rig floor. Tiering arms or other manual devices may be used to aid in delivering the tubular from the pipe rack to the hydraulic catwalk, however the tiering arms often require manual adjustment to provide for the tubulars properly rolling from the storage location to the hydraulic catwalk. For example, the height of the tiering arms may be adjusted by rig personnel. However, injuries may occur to personal positioned between the hydraulic catwalk and the stored tubulars at the rig site due to tubulars rolling off the tubular storage area towards the hydraulic catwalk at unexpected times. For example, personnel may be positioned between the pipe rack and the hydraulic catwalk due to a need to manually adjust the position of the tiering arms and/or due to a need to manually adjust the lateral position of the tubular to position the tubular properly relative to the hydraulic catwalk to for safely lifting the tubular to the catwalk. In addition, personnel may be injured when a tubular is raised by the indexers of the hydraulic catwalk and hits or bounces off the skate hood, goalpost, or other hydraulic catwalk features. Injuries to personnel may be reduced by providing a tubular handling apparatus that may be controlled remotely for delivering tubulars from the pipe rack to the hydraulic catwalk and further by properly positioning the tubular for lifting by the hydraulic catwalk, thereby reducing the need for personnel to be positioned between the pipe rack and the hydraulic catwalk. A tubular handling apparatus pursuant to embodiments of the present disclosure are provided herein. Tubulars as described throughout the present disclosure may refer to any of drill pipe, drill collars, tubing, casing, etc., unless otherwise noted herein.

Figure 1A:
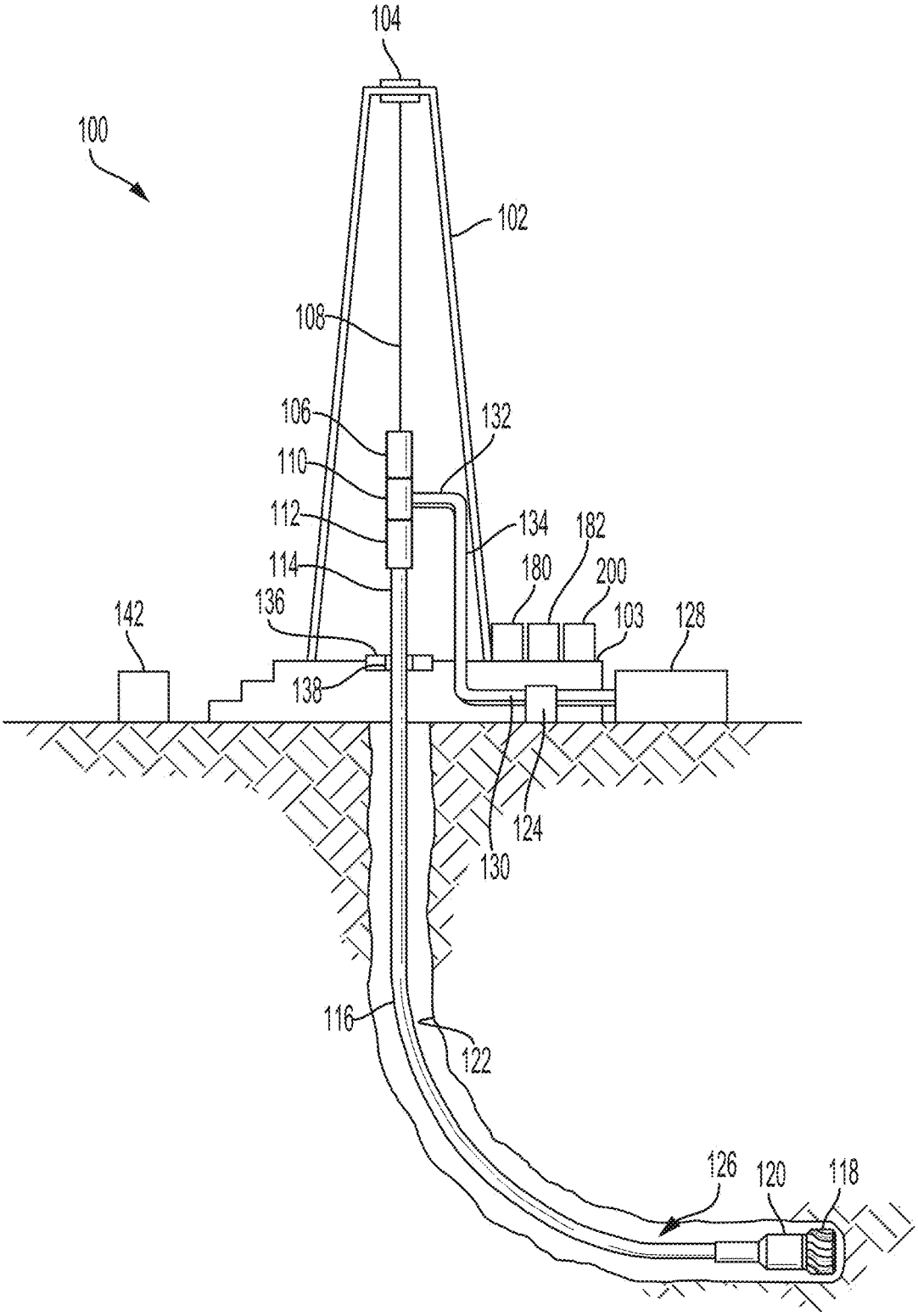
FIG. 1A illustrates one embodiment of a drilling system, in accordance with some embodiments of the present disclosure.

Referring to FIG. 1A, an embodiment of a drilling environment 100 is provided. Although the environment 100 is a drilling environment that is described with a top drive drilling system, it is understood that other embodiments may include other drilling systems, such as rotary table systems.

In the present example, the environment 100 includes a mast or derrick 102 on a drilling rig 103. The derrick 102 includes a crown block 104. A traveling block 106 is coupled to the crown block 104 via a drilling line 108. In a top drive system (as illustrated), a top drive 110 is coupled to the traveling block 106 and provides the rotational force needed for drilling. A saver sub 112 may sit between the top drive 110 and a drill pipe 114 that is part of a drillstring 116. The top drive 110 rotates the drillstring 116 via the saver sub 112, which in turn rotates a drill bit 118 of a BHA 120 in a borehole 122 in a formation. A mud pump 124 may direct a fluid mixture (e.g., mud) 126 from a mud pit or other container 128 into the borehole 122. The mud 126 may flow from the mud pump 124 into a discharge line 130 that is coupled to a rotary hose 132 by a standpipe 134. The rotary hose 132 is coupled to the top drive 110, which includes a passage for the mud 126 to flow into the drillstring 116 and the borehole 122. A rotary table 136 may be fitted with a master bushing 138 to hold the drillstring 116 when the drillstring is not rotating.

According to various embodiments, the drilling rig 103 may include various components such as a drawworks 180, power generation equipment 182, and any other auxiliary equipment (not shown).

Some or all of a control system 142 may be located at the derrick 102, may be downhole, and/or may be remote from the actual drilling location or adjacent the drilling location (e.g. within a podium, a control room, etc.). In some embodiments the control system 142 may be controlled by a worker positioned apart from the tubular handling apparatus but with a visual site line to the tubular handling apparatus. For example, the control system 142 may be a system such as is disclosed in U.S. Pat. No. 8,210,283 entitled System and Method for Surface Steerable Drilling, filed on Dec. 22, 2011, and issued on Jul. 3, 2012, which is hereby incorporated by reference in its entirety. Alternatively, the control system 142 may be a standalone system or may be incorporated into other systems at the derrick 102. The control system 142 may communicate via a wired and/or wireless connection (not shown).

Figure 1B:
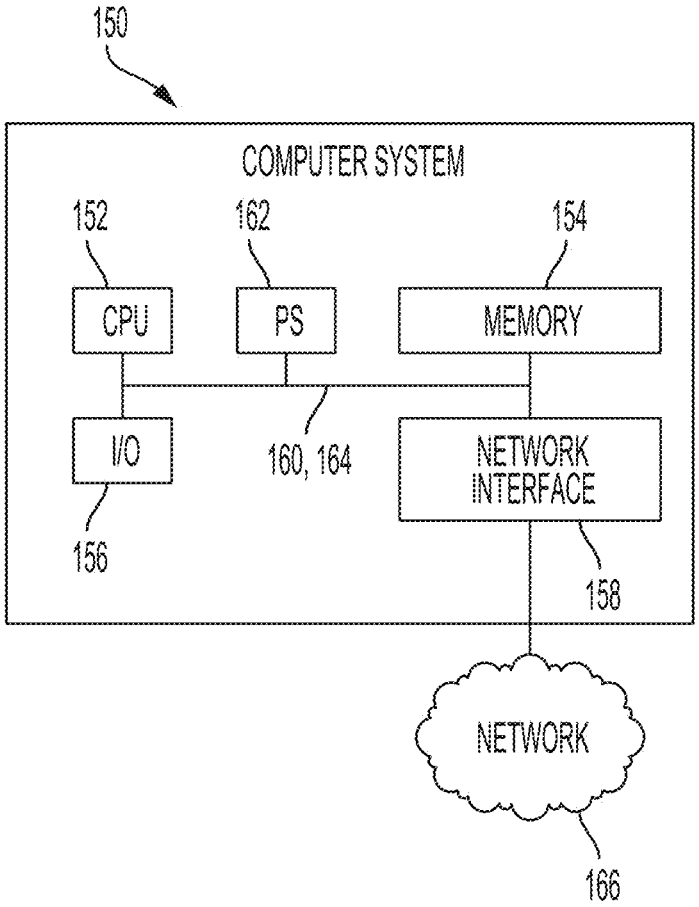
FIG. 1B illustrates one embodiment of a computer system or controller that may be used within the environment of FIG. 1A, in accordance with some embodiments of the present disclosure.

Referring to FIG. 1B, one embodiment of a computer system (or controller or control system) 150 is illustrated. The computer system 150 is one possible example of a system component or device such as the control system 142 of FIG. 1A or a separate system used to perform the various processes described herein. In scenarios where the computer system 150 is on-site, such as within the environment 100 of FIG. 1A, the computer system may be contained in a relatively rugged, shock-resistant case that is hardened for industrial applications and harsh environments. It is understood that downhole electronics may be mounted in an adaptive suspension system that uses active dampening as described in various embodiments herein.

The computer system 150 may include a central processing unit ("CPU") 152, a memory unit 154, an input/output ("1/0") device 156, and a network interface 158. The components 152, 154, 156, and 158 are interconnected by a transport system (e.g., a bus) 160. A power supply (PS) 162 may provide power to components of the computer system 150 via a power transport system 164 (shown with data transport system 160, although the power and data transport systems may be separate).

It is understood that the computer system 150 may be differently configured and that each of the listed components may actually represent several different components. For example, the CPU 152 may actually represent a multiprocessor or a distributed processing system; the memory unit 154 may include different levels of cache memory, main memory, hard disks, and remote storage locations; the I/O device 156 may include monitors, keyboards, and the like; and the network interface 158 may include one or more network cards providing one or more wired and/or wireless connections to a network 166. Therefore, a wide range of flexibility is anticipated in the configuration of the computer system 150.

The computer system 150 may use any operating system (or multiple operating systems), including various versions of operating systems provided by Microsoft (such as WINDOWS), Apple (such as Mac OS X), UNIX, and LINUX, and may include operating systems specifically developed for handheld devices, personal computers, and servers depending on the use of the computer system 150. The operating system, as well as other instructions (e.g., software instructions for performing the functionality described in previous embodiments) may be stored in the memory unit 154 and executed by the processor 152. For example, the memory unit 154 may include instructions for performing the various methods and control functions disclosed herein.

The network 166 may be a single network or may represent multiple networks, including networks of different types. For example, the network 166 may include one or more cellular links, data packet networks such as the Internet, local area networks (LANs), and/or wide local area networks (WLAN), and/or Public Switched Telephone Networks (PSTNs). Accordingly, many different network types and configurations may be used to couple the computer system 150 to other components of the environment 100 of FIG. 1A and/or to other systems not shown (e.g., remote systems).

Throughout this description for the purposes of explanation, numerous specific details are set forth to provide a thorough understanding of the many embodiments and embodiments disclosed herein. It will be apparent, however, to one skilled in the art that the many embodiments and embodiments may be practiced without some of these specific details. In other instances, known structures and devices are shown in diagram or schematic form to avoid obscuring the underlying principles of the described embodiments and embodiments.

According to embodiments of the present disclosure, a tubular handling apparatus 200 may be as shown in the non-limiting example below in FIG. 2. More or fewer features may be included in the apparatus 200 without departing from the intended scope of the present disclosure. In addition, one or more elements of the tubular handling apparatus 200 may be controlled via a wired or wireless connection such that the elements may be controlled remotely (e.g., sufficiently away from the apparatus and a pipe delivery system (e.g., a "hydraulic catwalk" or the like) such that personnel operating the tubular handling apparatus 200 are at a reduced risk of injury during the operation of the tubular handling apparatus 200). For example, the tubular handling apparatus 200 may be controlled (via a wired or wireless connection) from a podium or other location apart from the apparatus 200.

According to some embodiments of the present disclosure, the tubular handling apparatus 200 may be positioned against a catwalk 201 (for example but not limited to a hydraulic catwalk). In some embodiments, the apparatus may be coupled or secured to the catwalk 201. Various features of the apparatus, as described further below, may be controlled remotely, for example by personnel in a control podium or tower, for reducing the risk of injury to personnel by reducing the need for personnel to be positioned between the pipe rack 203 and the catwalk 201. The catwalk 201 may include one or more indexing arms that lift a tubular onto a top surface of the catwalk 201 for delivery to the derrick (not shown in FIG. 2).

Figure 2:
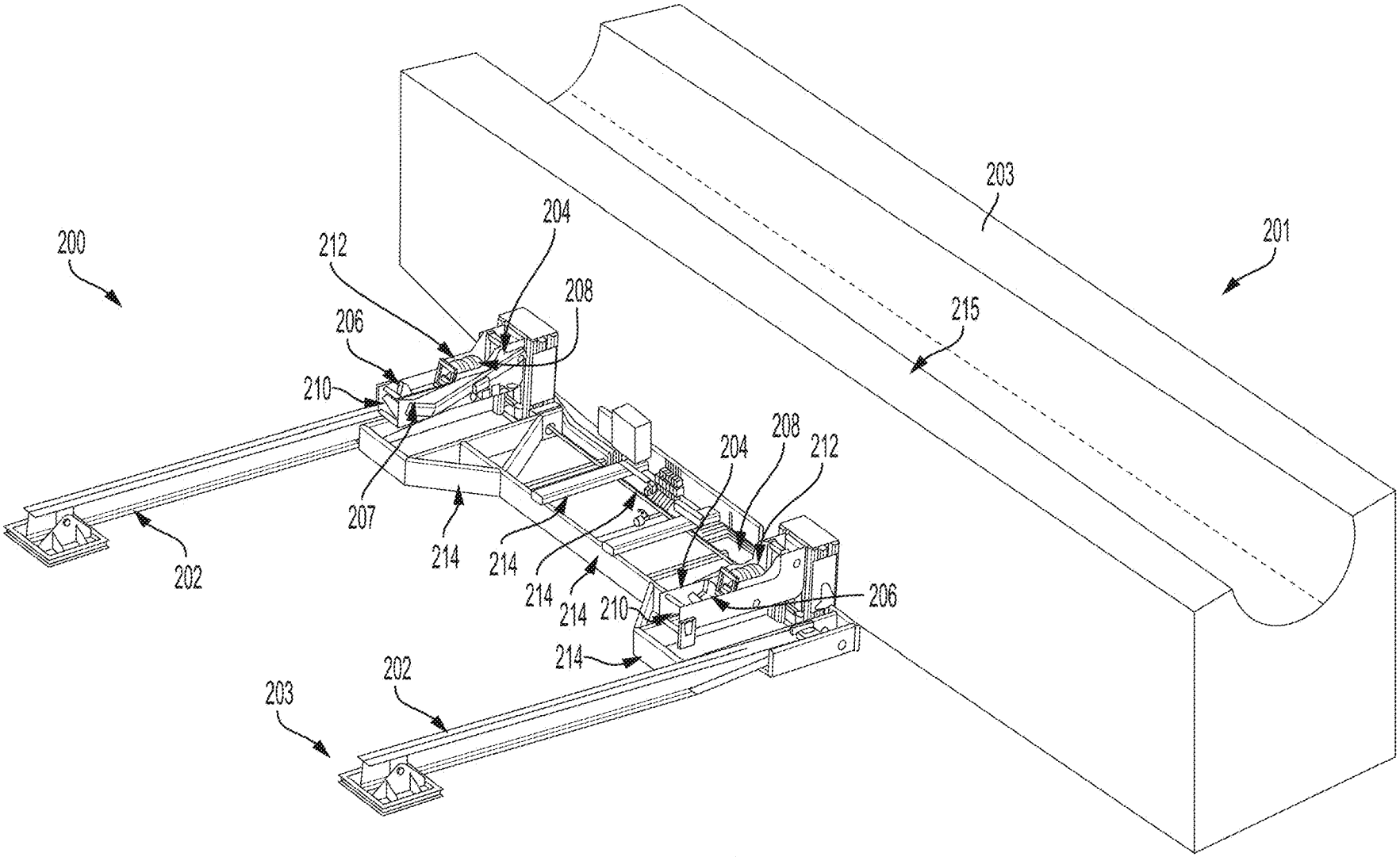
FIG. 2 is a perspective view of an exemplary tubular handling apparatus, in accordance with some embodiments of the present disclosure.

The apparatus 200 may include one or more beams 202, or rails, defining a pipe rack 203 for storing one or more tubulars (not shown in FIG. 2). The apparatus 200 may include one or more base plates 306 coupled to the beams 202, the base plates 306 may contact the ground upon which the apparatus 200 is placed and may aid in installing the apparatus 200 securely in place, for example by providing a wide flat underside surface that contacts the ground. Though the base plates 306 are depicted as being generally square in shape, other shapes may be used including but not limited to circles, triangles, rectangles, or any other suitable shape. The apparatus 200 may include one or more lifting arms 204 that may lift a tubular off the beams 202 defining the pipe rack 203. The lifting arms 204 may have a recess 207 or cut out (see also FIG. 5). The apparatus 200 may also include a tube sizer 206 which may project in a generally vertical direction and may act as a stop feature for preventing a tubular from rolling beyond the tube sizer 206 (see also FIG. 5). While the tube sizer 206 may stop the tubular from rolling further, the lifting arm 204 may move in an upwards direction, contacting an underside of the tubular, and lifting the tubular above the tube sizer 206. As the lifting arm 204 continues to raise the tubular the tubular may roll as a result of gravity backwards (towards the catwalk 201) until it settles into the recess 207 or cut-out in the lifting arm 204. With the tubular resting in the recess 207, the lifting arm 204 may then lower, causing the tubular to come to rest in a corresponding recess 208 or cut-out in a corresponding tiering arm 210 of the apparatus (see also FIG. 5). The recess 208 or cut-outs in the respective tiering arms 210 may cause the tubular to be positioned the desired distance from indexing arms of a dynamic positioning system (DPS) such that when the tubular is positioned with the recess 208, the tubular is able to be safely lifted onto the top surface of the catwalk by the indexing arms of the catwalk. The tiering arms 210 may be static arms that do not raise or lower, such that the lifting arms 204 move relative to the tiering arms 210. Though the terms recess and cut-out are used herein, it is to be understood that in some embodiments the recess or cut-out may correspond to an angular change, slope, or other feature that allows the tubular to come to rest in that location or otherwise may correspond to a change in the shape of the surface of the lifting arm 204 and/or tiering arm 210.

Figure 4:
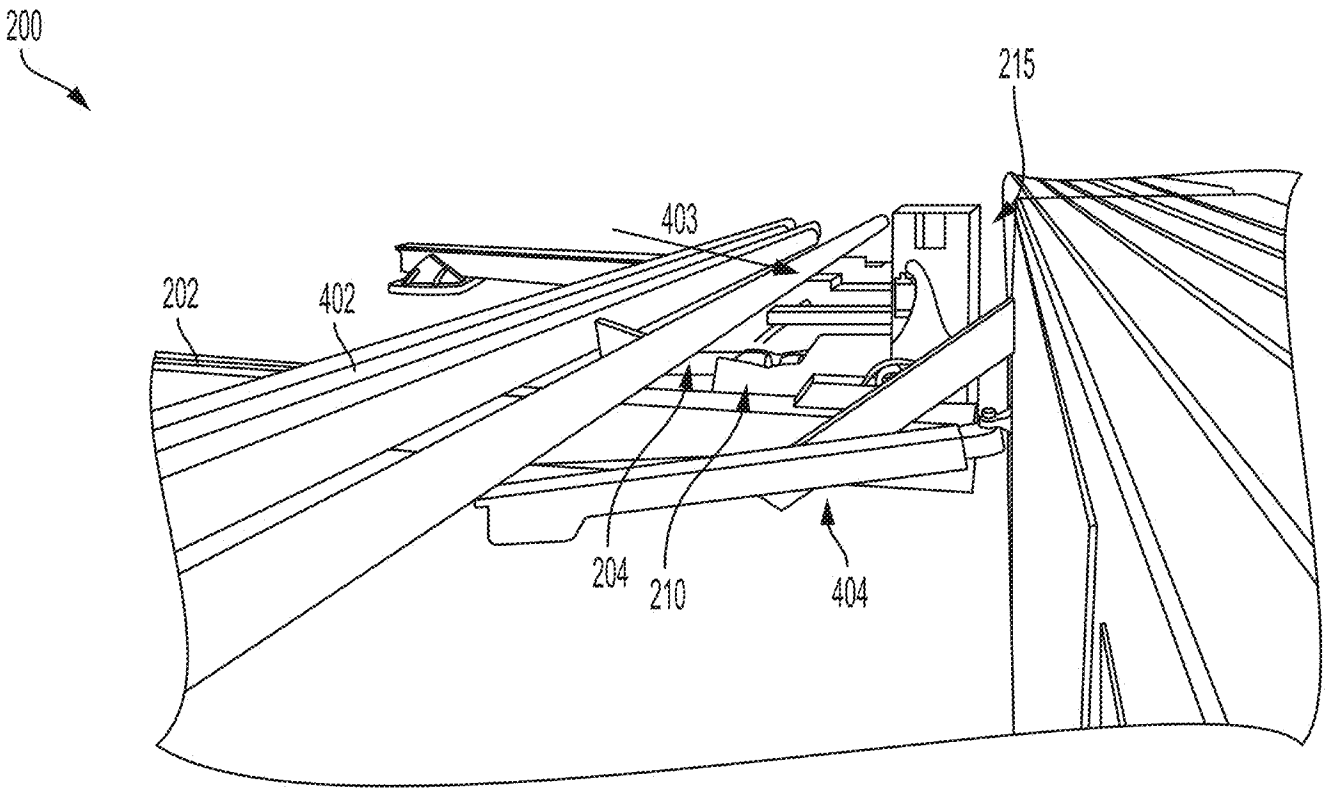
FIG. 4 is a side view of the exemplary tubular handling apparatus of FIG. 2 lifting a tubular in a lowered position, in accordance with some embodiments of the present disclosure.

According to some embodiments, the apparatus 200 may include one or more rollers 212 that may be in contact with the tubular when the tubular is resting in the recess 208 or cut-out of the tiering arm 210. The one or more rollers 212 may laterally move the tubular from one side to another to adjust the lateral position of the tubular relative to the apparatus and thereby relative to the indexing arms 404 of the catwalk 201 (as shown in FIG. 4). The lateral position of the tubular may be adjusted to position the tubular in a balanced or otherwise proper position for being safely lifted by the indexing arms 404. For example, if the tubular was offset to one side, the tubular may be unbalanced during lifting by the indexing arms 404 which may cause the tubular to fall off the indexing arms 404. An incorrect lateral position of the tubular may cause the tubular, when lifted, to hit the skate hood or goal post. By positioning the tubular on the tiering arms 210 at the appropriate distance from the indexing arms of the hydraulic catwalk, and by providing rollers 212 for moving the tubular into a desired linear position relative to the indexing arms 404, the tubular may thereby be optimally aligned such that it may be lifted safely by the indexing arms 404 of the catwalk from its resting spot on the tiering arms 210 of the apparatus 200.

According to various embodiments, the apparatus 200 may also include one or more support beams 214 that coupled together one or more features of the apparatus 200 and provide support for the various features of the apparatus 200. The support beams 214 may collectively be referred to as the housing 215. The housing 215 may provide for ease of installation and break-down of the apparatus 200 at the drill site. For example, the housing 215 may allow for the apparatus 200 to be a single unit or may provide for breaking down the apparatus 200 into two or more pieces for transport, storage, and installation. For example, the apparatus 200 may be a single unit comprising all the features of the apparatus 200 coupled together with the housing 215. In other embodiments, the apparatus 200 may be broken down into two or more pieces, for example the beams 202 defining the pipe rack 203 may be decoupled from the remaining features of the apparatus 200, which may be coupled together via the housing 215, to make the apparatus 200 smaller in size for shipping and/or storage. The housing 215 may also be sized and shaped to provide space for receiving one or more hydraulic/pneumatic cylinders, motors, hydraulic driven jack screws, etc., that control the various features of the apparatus 200, including but not limited to cylinders/motors that control the height/angle of the beams 202 defining the pipe rack 203, the lifting arms 204, the rollers 212, and/or the elevation/position of the tiering arms 210.

In at least some embodiments in which the apparatus 200 includes one or more rollers 212 the tubulars on the pipe rack 203 may be stacked on the pipe rack 203 with the ends of the respective tubulars misaligned. In other words, the tubulars need not be aligned in their stacked position on the pipe rack 203 (defined by the beams 202 of the apparatus 200) as the one or more rollers 212 may adjust the lateral position of the tubular as needed to position the tubular in the correct location for safe lifting by the indexing arms of the hydraulic catwalk.

In addition, one or more elements of the apparatus 200, including the lifting arms 204 and/or the rollers 212 may be controlled remotely, further reducing the risk of injury to personnel. For example, by reducing the need for personnel to manually align the ends of the tubulars on the pipe rack 203, the apparatus 200 reduces the risk of injury to personnel standing between the pipe rack 203 and the DPS. In addition, the elevation of the tiering arms 210 relative to the ground may be adjusted based on the tier or level of the tubular being delivered from the pipe rack 203 and the elevation position of the tiering arms 210 may be controlled remotely to further reduce the likelihood of injury to personnel. The tiering arms 210 may be raised and lowered using hydraulic driven jack screws, in at least some embodiments.

Figure 3:
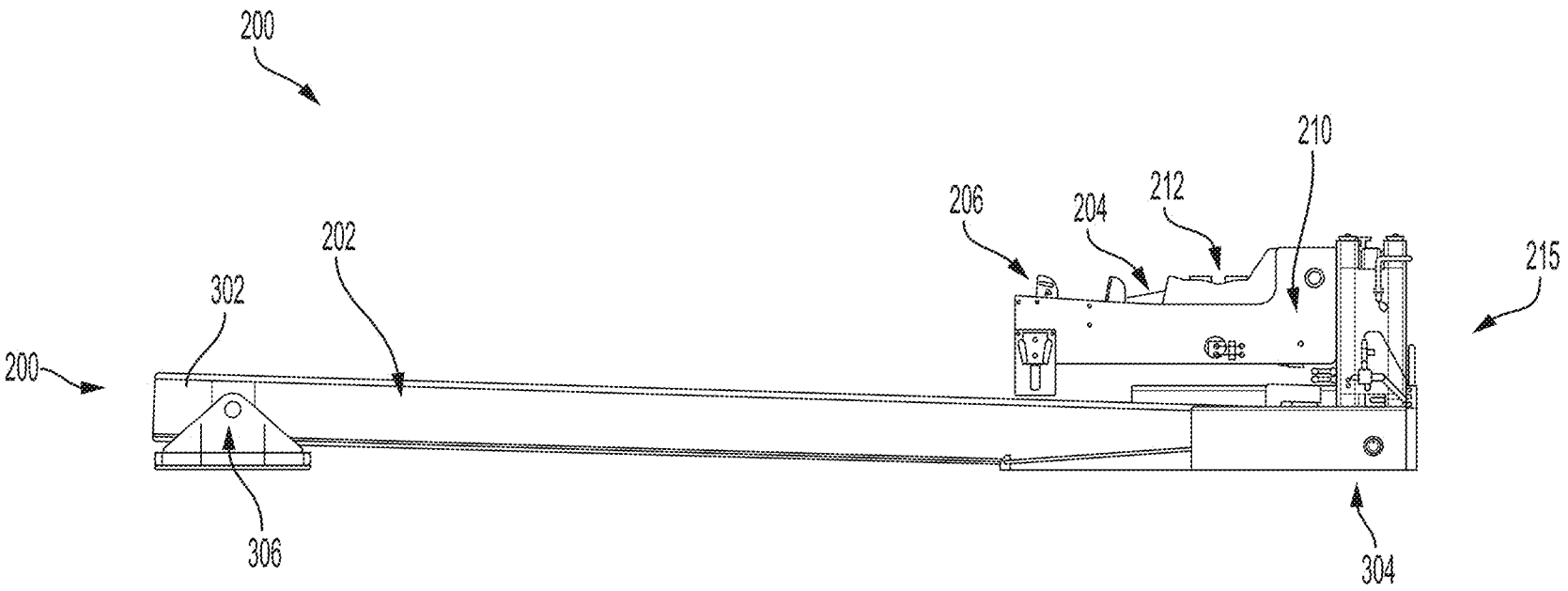
FIG. 3 is a side view of the exemplary tubular handling apparatus of FIG. 2, in accordance with some embodiments of the present disclosure.

FIG. 3 is an exemplary and non-limiting side view of the tubular handling apparatus 200 of FIG. 2. As shown in FIG. 3, the beams 202 that define the pipe rack 203 may be angled with a first end 302 being higher than a second end 304 adjacent the housing 215. Such an angle may allow for tubulars to roll down the beams 202 from the pipe rack 203 towards the lifting arms 204 and tiering arms 210 of the apparatus 200 by way of gravity. The angle of the beams 202 may be controlled via a hydraulic/pneumatic cylinder or other suitable means for controlling the angle of the beams 202. The one or more beams 202 may be coupled to the housing 215 of the apparatus 200 at the second end 304. The angle of the one or more beams 202 may be adjusted, including remotely, so as to raise the second end 304 of the beam level with or higher than the first end 302, for example, to prevent tubulars from rolling towards the hydraulic catwalk (not shown) when personnel need to access the region between the pipe rack 203 and the hydraulic catwalk. Each beam 202 may also include the base plate 306 that extends between the first end 302 of the beam 202 and the ground surface for aiding in securing the pipe rack 203 (and the apparatus 200 in its entirety) in position.

According to some embodiments, the one or more tube sizers 206 may be sized, shaped, and positioned to prevent a particular sized tubular from rolling beyond the tube sizer 206. In other words, the one or more tube sizers 206 may aid in retaining the tubulars on the beams 202 (or the pipe rack 203), thereby preventing the tubulars from rolling further down the tiering arm 210. In addition, a sensor or other suitable device (not shown) may be positioned adjacent the tube sizers 206 for detecting the presence of a tubular in position to be lifted by the lifting arms 204. A communication device may also be used to send a signal to a controller (for example at the catwalk podium) indicating a tubular is ready to be lifted by the lifting arms 204 and the signal may be sent via a wired or wireless communication link. The lifting arms 204 may be raised and lowered using hydraulic cylinders. For example, the lifting arms 204 may be actuated or raised from a lowered position in which a front edge surface of the lifting arms 204 are below the tubular, to lift the tubular adjacent the tube sizer 206 onto the lifting arms 204 and over the tube sizers 206 as the lifting arms 204 are raised.

FIG. 4 is an exemplary and non-limiting side view of the tubular handling apparatus of FIG. 2 lifting a tubular 402. FIG. 4 depicts a plurality of tubulars 402 positioned on the beams 202 of the apparatus 200. The lifting arms 204 may be actuated or raised from a lowered position (as shown) in which a front edge surface of the lifting arms 204 are below the tubular 402, to lift the tubular 402 adjacent the tube sizer 206, onto the lifting arms 204, and over the tube sizers 206. The lifting arms 204 may continue to rise upwards causing the tubular 402 to roll along a top edge surface of the lifting arms 204 in direction 403. The lifting arms 204 may have one or more angled portions that aid in controlling the position of the tubular as the lifting arms 204 are raised. As the lifting arms 204 are raised, the front edge of the lifting arm 204 may prevent additional tubulars 402 from rolling forward and engaging the tube sizer 206.

In some embodiments, and as shown in FIG. 4, the apparatus 200 is used in conjunction with indexing arms 404 of a catwalk 406 for loading tubulars 402 to their next destination, which may be on a surface of the catwalk 406.

Figure 5:
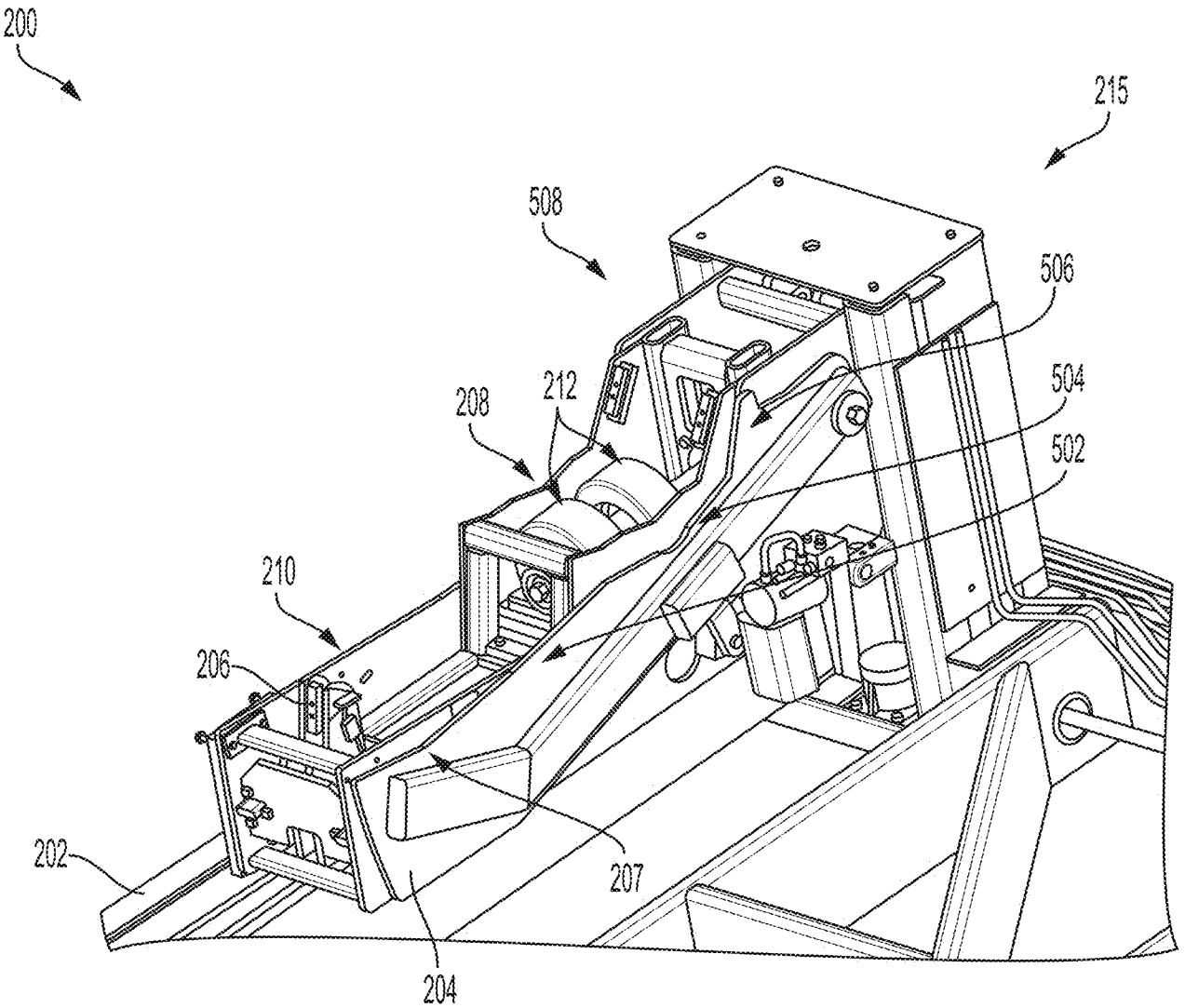
FIG. 5 illustrates an exemplary tiering arm and an exemplary lifting arm, in accordance with some embodiments of the present disclosure.

FIG. 5 is a close-up view of a portion of the apparatus 200, in particular a non-limiting exemplary tiering arm 210 and lifting arm 204. The lifting arm 204 may include a first angled portion defining a first recess (e.g., recess 207), or cut-out, that may be defined by a downward sloped surface which intersects with an upwards sloped surface 502 forming a generally V or U-shaped region. The length and angle of the upwards sloped surface 502 may aid in controlling the speed of the tubular (such as tubular 402) as it rolls towards a second recess 504 or cutout of the lifting arm 204. As shown in FIG. 5, in some embodiments the second recess 504 or cutout may be generally concave in shape so as to correspond with the generally curved outer surface of the tubular. In addition, the upper edges of the lifting arm 204 adjacent either end of the second recess 504 or cutout may be angled to aid in guiding the tubular into the second recess 504 and preventing the tubular from rolling past the second recess 504 towards the rear end of the lifting arm 204. In addition, the lifting arms 204 may have an angled or sloped rear edge region 506 that aids in preventing the tubular from rolling off the rear end of the lifting arm 204. The second recess 504 or cutout of the lifting arm 204 may be positioned such that it aligns with a recess 208 or cutout in a corresponding tiering arm 210 of the apparatus 200. As shown in FIG. 5, the recess 208 of the tiering arms 210 may also be generally shaped to correspond to the second recess 504 of the lifting arms 204. In addition, the tiering arms 210 may also have a rear edge region 508 that is angled or sloped to aid in preventing the tubular from rolling off the rear end of the tiering arms 510.

According to various embodiments, the alignment of the second recesses 504 or cutouts in the lifting arms 204 and the recesses/cutouts 208 in the tiering arms 210 provides for the tubular being retained in respective the recesses 208 or cutouts of the tiering arms 210 when the lifting arms 204 are lowered such that they no longer support the tubular. Thus, upon the lowering of the lifting arms 204, the tubular is engaged in the recesses 208 of the tiering arms 210.

According to some embodiments, the optional rollers 212 of the apparatus 200 may be positioned such that they straddle and contact the sides of the tubular when the tubular is positioned in the recess 208 or cutout of each tiering arm 210. The shape of the recess 207 and the second recess 504 of the lifting arms 204 aid in bringing the tubular to a rest within the recesses 208 of the tiering arms 210 with minimal force to aid in preventing damage to the rollers 212 and other elements of the apparatus 200 that may be caused by the tubular bouncing or otherwise landing with great force on the rollers 212. In addition, the recesses 208 in the tiering arms 210 allows for smaller diameter tubulars and also allows for wear tolerances in the rollers 212.

The location of the recess 207 and the second recess 504 of the lifting arms 204 and thereby the location of the corresponding recesses 208 in the tiering arms 210 may position the tubular in a desired distance from the indexing arms of the hydraulic catwalk (e.g., indexing arm 404 of the hydraulic catwalk 406 as shown in FIG. 4) to safely lift and move the tubular to the catwalk. The rollers 212 allow for adjustment of the tubular to position the tubular in a sufficiently balanced position relative to the indexing arms to reduce the likelihood of the tubular falling off the indexing arms when they lift and move the tubular. The position of the tubular may also be controlled for preventing the tubular from hitting the skateboard or goalpost. The longitudinal position of the tubular may be controlled remotely from a tower or podium based on the alignment of the tubular with visual markers such as one or more cones or other visual markers. In other embodiments the longitudinal position of the tubular may be determined by a sensor. In still yet other embodiments, the longitudinal position of the tubular may be automatically controlled by a computing device using input from a sensor that indicates the current longitudinal position of the tubular and a computing program that provides for a desired longitudinal position of the tubular. By sensing both ends of the tubular, the sensor(s) may compute the overall length of the tubular for the purpose of delivering the tubular to the trough at a known distance away from the skate hood. The distance from the skate and the overall tubular length may be transmitted (via a wired or wireless connection) to the hydraulic catwalk. This information may be used to identify what distance to skate the tubular in the hydraulic catwalk trough to present the end of the tubular at the rig floor in the desired location.

In addition, when the lifting arms 204 are moved to a lowered position, the front edge of the lifting arm 204 may move below the level of pipe being fed into the apparatus allowing the next pipe to roll down the beams of the pipe rack and engage with the tube sizers. One or more sensors near the tube sizers 206 may send a signal to a controller located in a remote location that there is a tubular ready for lifting by the lifting arms. The tube sizers 206 may prevent the tubular from rolling further until the first tubular has been moved by the indexing arm of the hydraulic catwalk.

According to at least some embodiments, additional protective guards (not shown) may be provided on the apparatus 200 to prevent damage and reduce wear and tear to the apparatus 200.

Figure 6:
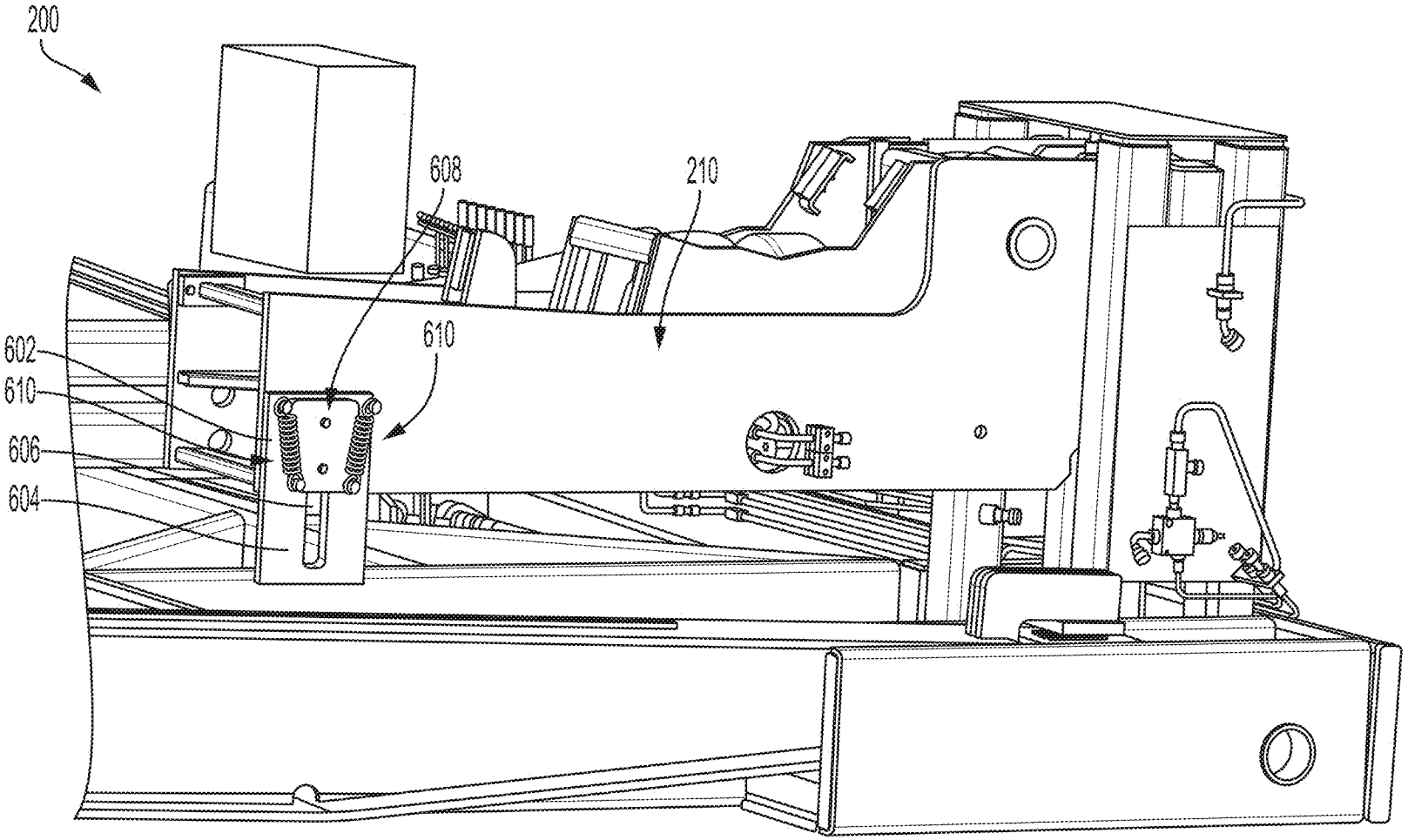
FIG. 6 is a side view of the exemplary tiering arm of FIG. 5, in accordance with some embodiments of the present disclosure.

FIG. 6 is a side view of the exemplary tiering arm of FIG. 5. As shown in FIG. 5, the apparatus 200 may include a stopper 602 (e.g., a stopper plate) coupled to one or more tiering arms 210. The stopper 602 may include a housing plate 604 having a slot 606 or cutout therein. The stopper 602 may further include a moving block 608 that is couped to housing plate 604 and one or more springs 610. The moving block 608 may move along the slot 606 of the housing plate 604. In some positions, the moving block 608 may extend below a bottom or lower edge of the respective tiering arm 210 and/or the housing plate 604 for preventing tubulars from rolling off the pipe rack underneath the respective tiering arm 210. The springs 610 may aid in positioning the moving block 608 by allowing the moving block 608 to move downward in response to the raising of the tiering arm 210 using gravity. As the tiering arm 210 is lifted, the springs 610 are coupled to a fixed point on the tiering arm 210 (optionally the housing plate 604) and gravity causes the moving block 608 to move in a downward direction as the moving block 608 moves along the slot 606 in the housing plate 604.

Figure 7:
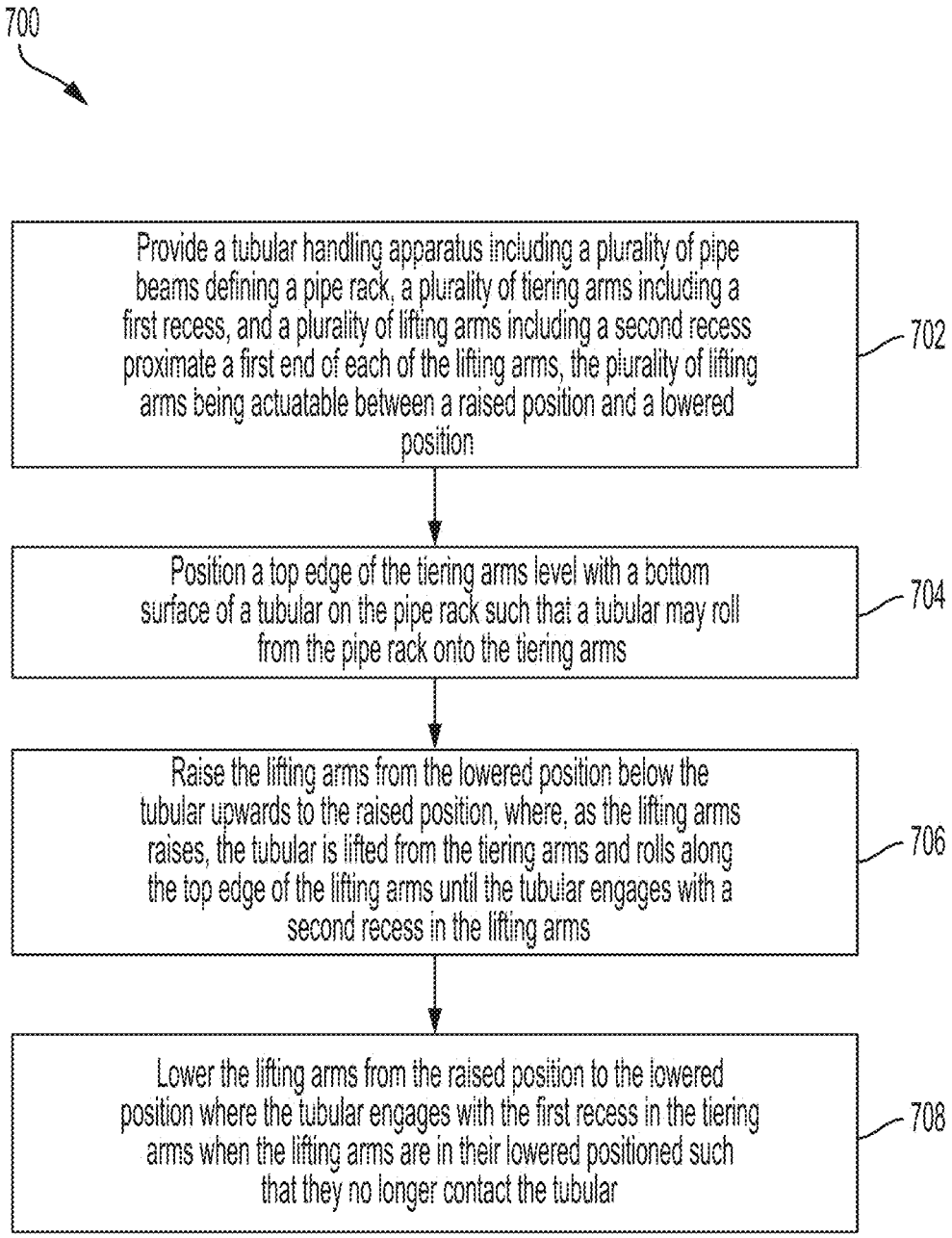
FIG. 7 is a flowchart of a method of rolling a tubular in position, in accordance with some embodiments of the present disclosure.

FIG. 7 is a flowchart of an exemplary method of installation of a tubular handling apparatus, such as tubular handling apparatus 200 described in detail with respect to at least FIGS. 2-6. More or fewer steps than those disclosed herein may be used. Furthermore, steps may be taken in a different order than as provided herein. Method 700 may include steps 702. Step 702 may include providing a tubular handling apparatus including a plurality of pipe beams defining a pipe rack, a plurality of tiering arms including a first recess, and a plurality of lifting arms including a second recess proximate a first end of each of the lifting arms. The plurality of lifting arms may be actuatable between a raised position and a lowered position. The tubular handling apparatus may include any combination of embodiments of the tubular handling apparatus 200 described above. According to various embodiments, a "plurality" may refer to a "pair," e.g., at least two of a component. However, a plurality may refer to three or more, four or more, five or more, etc.

According to various embodiments, a housing of the apparatus, including the tiering arms and lifting arms, may be positioned between indexing arms of a position delivery system and up against the position delivery system. The position delivery system may be a hydraulic catwalk according to at least some embodiments. The pipe beams may then be positioned and slid into place in the housing. The base plates of the beams may be cribbed to account for an uneven terrain to properly level the pipe beams defining the pipe rack. The pipe beams, tiering arms, and lifting arms may be raised prior to loading the pipe beams with tubulars.

According to some embodiments, a first cone may be placed in line with the red rollers and the hydraulic catwalk skate hood, and another cone may be positioned in line with the hydraulic catwalk trough goalpost. The cones may be used to show when a tubular is misaligned longitudinally such that is may hit the skate hood or goalpost. The position of the tubular relative to the cones may be used as a visual check for proper positioning of the tubular using the rollers. In some embodiments, a sensor may be used in lieu of or in addition to a physical visual marker such as the cone(s). One or more power cords and data cables from the hydraulic catwalk may be hooked up to the apparatus for providing power and a communication link. One or more hydraulic lines and return lines may be hooked up between the apparatus and the rigs main HPU for controlling one or more cylinders and/or jack screws of the apparatus. The one or more cylinders and/or jack screws may control the actuation of the pipe beams, the tiering arms, the lifting arms, and/or the rollers.

Step 704 may include positioning a top edge of the tiering arms level with or below a bottom surface of a tubular on the pipe rack such that a tubular may roll from the pipe rack onto the tiering arms. Tubulars may be loaded on the pipe beams defining the pipe rack, while the lifting arms remain elevated relative to the tiering arms. The lifting arms may prevent the tubular from rolling on the tiering arms and against the pipe sizers.

Step 706 may include raising the lifting arms from the lowered position below the tubular upwards to the raised position, where, as the lifting arms raises, the tubular is lifted from the tiering arms and rolls along the top edge of the lifting arms until the tubular engages with a recess in the lifting arms.

Step 708 may include lowering the lifting arms from the raised position to the lowered position where the tubular engages with a recess in the tiering arms when the lifting arms are in their lowered positioned such that they no longer contact the tubular. The lifting arms may then be lowered, allowing the tubular to roll onto the tiering arms and up against the pipe sizers, the pipe sizers may be adjusted to the size of the tubular either remotely or manually. For example, the tubular may roll backwards towards the rear edge region of the lifting arms via gravity, with the tubular coming to rest in the second recesses of the lifting arms. The lifting arm may be lowered, and the tubular may come to rest on the rollers of the tiering arm, within the recess of the tiering arm. The tubular may be moved longitudinally to the desired position by the rollers. The indexers of the hydraulic catwalk may then be actuated to lift and move the tubular. The additional tubulars may roll into place upon the lowering of the lifting arms below the bottom surface of the next tubular.

According to various embodiments, the apparatus may then be actuated to roll a tubular into position for lifting by the indexing arms of the hydraulic catwalk. To lift the tubular, the lifting arms lift up from under the tubular that is in place against the pipe sizers (on the tiering arms) to raise the tubular up and over the pipe sizers.

FIGS. 8-12 illustrate various embodiments of an exemplary method of installation of a tubular handling apparatus. FIGS. 8-12 depict a side view as well as a top view of the steps described herein, such as with respect to at least method 700 of FIG. 7.

Figure 8:
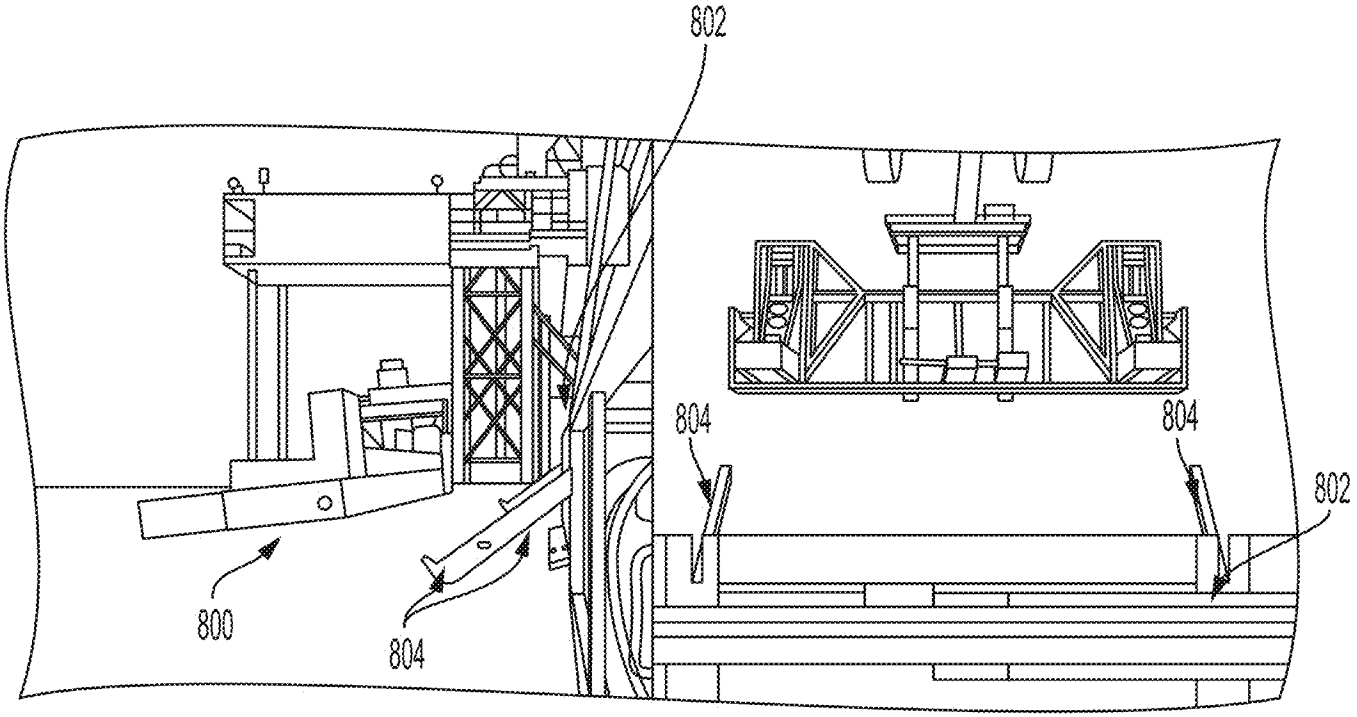
FIGS. 8-12 illustrate various embodiments of an exemplary method of installation of a tubular handling apparatus, in accordance with some embodiments of the present disclosure.
Figure 9:
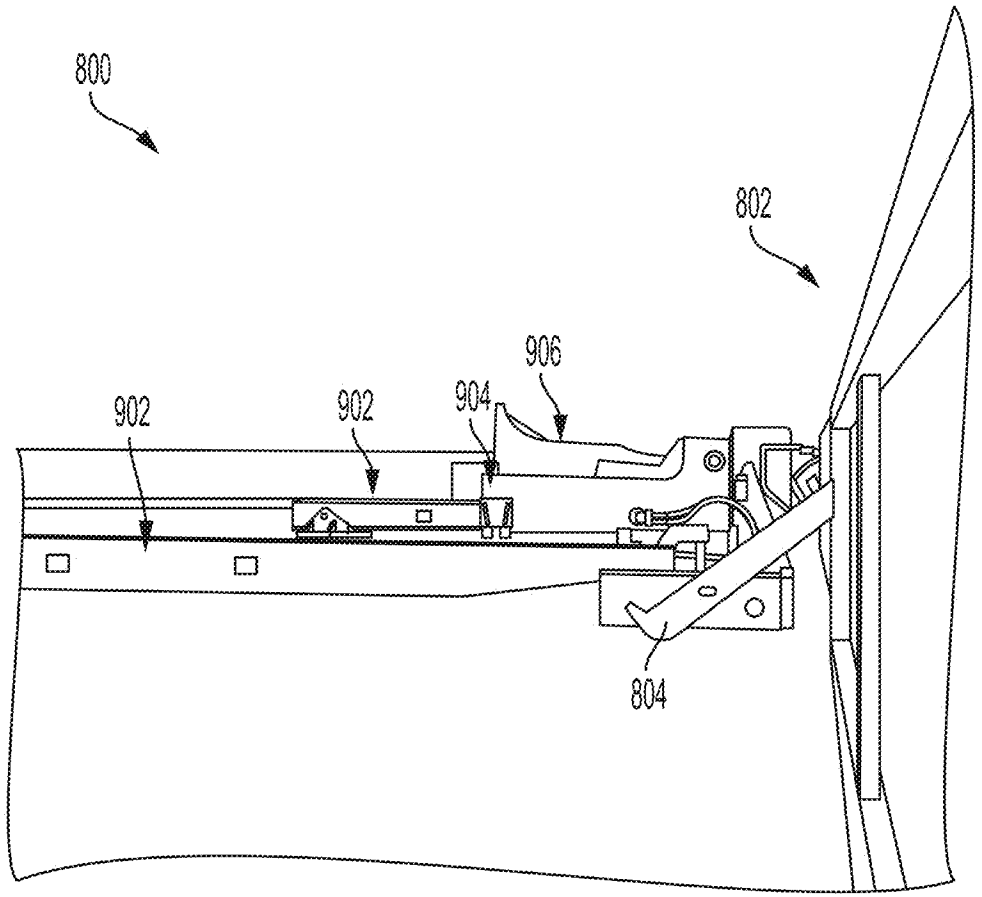

FIG. 8 illustrates the tubular handling apparatus 800 positioned relative to a hydraulic catwalk 802 and indexing arms 804 of the hydraulic catwalk 802. FIG. 9 illustrates the beams 902 of the tubular handling apparatus 800 positioned relative to the hydraulic catwalk 802 and the indexing arms 804 of the hydraulic catwalk 802. As shown in FIG. 9, the tiering arm(s) 904 (and the lifting arm(s) 906 coupled thereto) may be in an elevated or raised position relative to the beams 902 prior to tubulars being placed on the beams.

Figure 10:
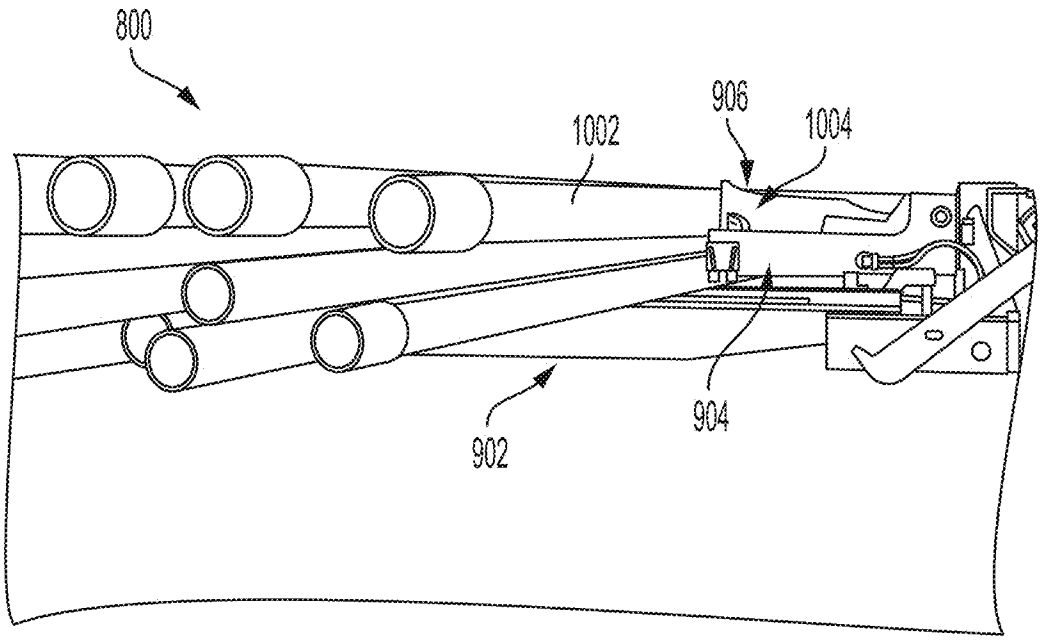

FIG. 10 illustrates tubulars 1002 placed on the beams 902. As shown, the tubulars 1002 are positioned such that a lower level of the tubulars 1002 are blocked from rolling further along the apparatus 800 by the front face of the tiering arms 904 and an upper level of the tubulars 1002 are blocked from rolling farther along the apparatus 800 by the front face of the lifting arms 906. FIG. 10 may illustrate various embodiments of step 704 of method 700 described with respect to FIG. 7. For example, a top edge of the tiering arms 904 may be positioned such that it is level with a bottom surface of a tubular 1002 on the beams 902 such that a tubular 1002 may roll from the beams 902 onto the tiering arms 904. With the tubulars 1002 loaded on the beams 902, the tiering arms 904 may be lowered until the tops of the tiering arms 904 are even with the bottom of the tubular 1002 to be moved, while the lifting arms 906 remain elevated relative to the tiering arms 904. The lifting arms 906 may prevent the tubular 1002 from rolling on the tiering arms 904 and against pipe sizers 1004.

Figure 11:
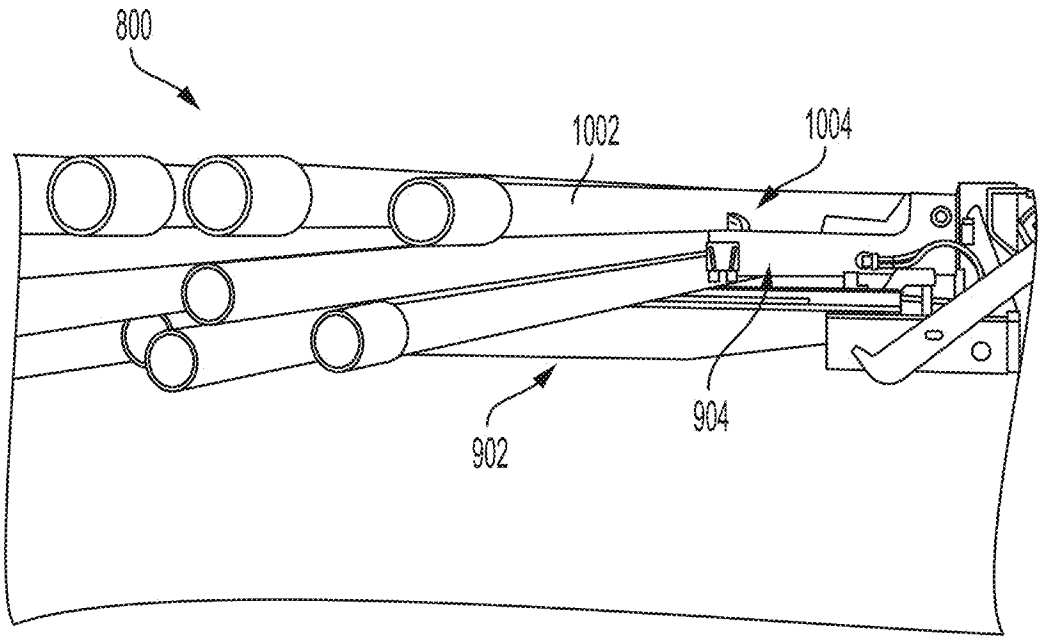

FIG. 11 illustrates various embodiments of step 708 of method 700 described with respect to FIG. 7. For example, the lifting arms 906 are lowered from the raised position to the lowered position where the tubular 1002 engages with a recess in the tiering arms 904 such that the lifting arms 906 no longer contact the tubular 1002. The lifting arms 906 may be lowered, allowing the tubular 1002 to roll onto the tiering arms 904 and up against the pipe sizers 1004. For example, the lifting arms 906 may be lowered below the upper level of the tubulars 1002 thereby allowing a topmost tubular 1002 to roll and contact the pipe sizer 1004 (or a stopper component of the apparatus 800). The tubular 1002 may be moved longitudinally to the desired position by the rollers. The indexers of the hydraulic catwalk may then be actuated to lift and move the tubular.

Figure 12:
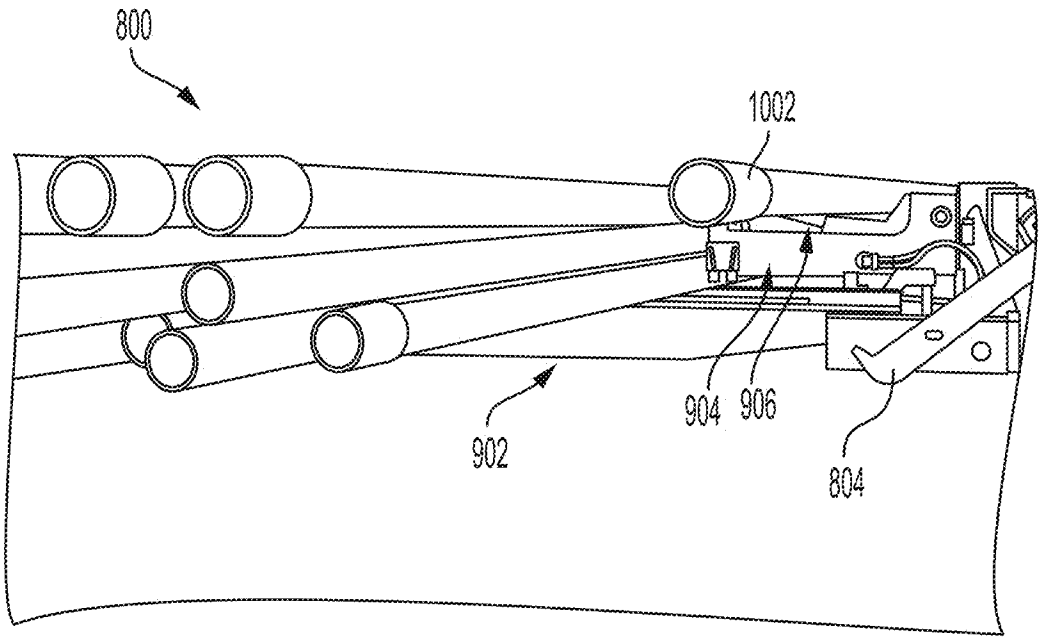

FIG. 12 illustrates actuating the apparatus 800 to roll the tubular 1002 into position for lifting by the indexing arms of the hydraulic catwalk. To lift the tubular 1002, the lifting arms 906 lift up from under the tubular 1002 (e.g., previously the topmost tubular 1002) that is in place against the pipe sizers 1006 (on the tiering arms 904) to raise the tubular 1002 up and over the pipe sizers 1006, as shown in FIG. 12. The indexing arms 904 of the hydraulic catwalk 802 may then be actuated to lift and move the tubular 1002. The additional tubulars 1002 may roll into place upon the lowering of the lifting arms 906 below the bottom surface of the next tubular 1002.

In one embodiment, the tubular handling system and methods described herein may be used and/or integrated with one or more computer vision systems. For example, the tubular handling system described herein may be integrated with a computer vision system adapted to detect one or more personnel in one or more areas of interest and, if such one or more persons are detected in an area of interest, to sound an alarm, issue an alert, and/or stop or modify the operation of equipment. For example, if a person is detected in or near the tubular handling apparatus described herein, and that proximity is deemed unsafe, the computer vision system may send a signal to the control system of the tubular handling system to halt operations. As another example, if the computer vision system detects that a person has an arm caught under a pipe, it may be desirable to speed up the lifting of the pipe before halting operations. Depending on the location of the person, his or her movement, and the state of the operation of the tubular handling system, one or more operations of the tubular handling system may be slowed, sped up, stopped, or otherwise altered in order to avoid injury to any personnel. Computer visions that may be useful and may be integrated with the tubular handling system shown and described herein include those found in U.S. Pat. No. 10,957,177 B2, issued on Mar. 23, 2021, titled "Systems and Methods for Oilfield Operations Using Computer Vision," and U.S. Pat. No. 10,958,877 B2, issued on Mar. 23, 2021, titled "System and Method for Inhibiting or Causing Automated Actions Based on Person Locations Estimated from Multiple Video Sources," both of which are hereby incorporated by reference as if fully set forth herein.

Furthermore, relative terms such as, "lower", "upper, "up", "down", "above", "below," "downward," "upward" and the like are used herein to indicate directions and locations as they apply to the appended drawings and will not be construed as limiting the invention and features thereof to particular arrangements or orientations.

In some embodiments of the present disclosure, more or fewer steps may be performed from the exemplary methods and operations described above. For example, although the discussion above has been primarily focused on making-up and breaking-out drill pipe, many of the disclosed steps and same equipment may be used for making-up or breaking-out a casing. In addition, the methods and operations described herein may also be performed in reverse for breaking-out a drill pipe or casing.

The subject matter of embodiments of this patent is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Different arrangements of the components depicted in the drawings or described above, as well as components and steps not shown or described, are possible. Similarly, some features and subcombinations are useful and may be employed without reference to other features and subcombinations. Embodiments of the disclosure have been described for illustrative and not restrictive purposes, and alternative embodiments will become apparent to readers of this patent. Accordingly, the present disclosure is not limited to the embodiments described above or depicted in the drawings, and various embodiments and modifications can be made without departing from the scope of the claims below.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilize the invention in various embodiments and with various modifications as are suited to the particular use contemplated. Therefore, further modifications or improvements may be incorporated without departing from the scope of the invention herein intended.

What is claimed is:

1. A tubular handling apparatus comprising:

a plurality of pipe beams defining a pipe rack;

a plurality of tiering arms, each having a first recess; and a plurality of lifting arms, each lifting arm corresponding to one of the plurality of tiering arms, and each lifting arm having a second recess proximate a first end of each of the lifting arms, wherein each second recess is aligned with a first recess of a corresponding tiering arm, the plurality of lifting arms being actuatable between a raised position and a lowered position relative to the plurality of tiering arms, wherein a top surface of each of the plurality of pipe beams comprises a slope extending downward towards the plurality of tiering arms;

wherein each lifting arm of the plurality of lifting arms comprises a third recess proximate a second end of the lifting arm configured such that a tubular will rest within the third recess before rolling into the second recess as the lifting arm moves from the lowered position to the raised position.

2. The tubular handling apparatus of claim 1, further comprising:

a plurality of pipe sizers that are movable and adapted to accommodate a plurality of tubular sizes.

3. The tubular handling apparatus of claim 1, wherein each lifting arm of the plurality of lifting arms comprises an angled rear end region adapted to block a tubular from rolling off the rear end region.

4. The tubular handling apparatus of claim 1, further comprising a plurality of rollers positioned within the tiering arms for engaging with and moving a tubular positioned within the first recess of the tiering arms.

5. The tubular handling apparatus of claim 1, further comprising:

at least one hydraulic cylinder coupled to the plurality of lifting arms for actuating the lifting arms from their respective lowered positions to their respective raised positions.

6. The tubular handling apparatus of claim 1, further comprising a stopper plate having a moving block coupled to at least one spring, the moving block movable within a slot in a housing plate and adapted to block a tubular from rolling beneath the tiering arm.

7. The tubular handling apparatus of claim 1, wherein the plurality of tiering arms are actuatable between an elevated position and a lowered position.

8. The tubular handling apparatus of claim 1, wherein the apparatus is adapted to be placed adjacent or near to a pipe delivery system for a drilling rig, wherein the pipe delivery system comprises a trough and the apparatus is adapted to lift a tubular from a first position resting on the plurality of pipe beams or one or more tubulars resting on the plurality of pipe beams to a second position, from which the tubular rolls into the trough of the pipe delivery system.

9. The tubular handling apparatus of claim 1, further comprising a control system for controlling movement of the tiering arms and/or the lifting arms.

10. The tubular handling apparatus of claim 9, wherein the control system is adapted to move the tiering and/or the lifting arms in response to a user command therefor.

11. The tubular handling apparatus of claim 10, wherein the control system is coupled to a user control device by a wired or wireless coupling.

12. A method of moving a tubular, the method comprising:

providing a tubular handling apparatus comprising:

a plurality of pipe beams defining a pipe rack;

a plurality of tiering arms each having a first recess; and a plurality of lifting arms each having:

a second recess proximate a first end of each of the lifting arms, the plurality of lifting arms being actuatable between a raised position and a lowered position;

positioning a top edge of the tiering arms generally level with a bottom surface of a tubular on the pipe rack such that a tubular may roll from the pipe rack onto the tiering arms;

raising the lifting arms from the lowered position below the tubular upwards to the raised position, wherein as the lifting arms raise, the tubular is lifted from the tiering arms and rolls along the top edge of the lifting arms until the tubular engages with the second recess in the lifting arms; and lowering the lifting arms from the raised position to the lowered position, wherein the tubular engages with the first recess in the tiering arms when the lifting arms are in their lowered positioned such that they no longer contact the tubular.

13. The method of claim 12, further comprising:

actuating a plurality of rollers on the tubular handling apparatus for moving the tubular in a longitudinal direction.

14. The method of claim 12, wherein the tubular handling apparatus further comprises a plurality of pipe sizers, and wherein the step of raising the lifting arms from a lowered position below the tubular upwards to a raised position further comprises lifting the tubular over the pipe sizers.

15. The method of claim 14, wherein the step of lowering the lifting arms from the raised position to the lowered position, further comprises lowering a top edge of the lifting arms below a bottom surface of a second tubular such that the second tubular rolls onto the tiering arm and engages with the pipe sizers.

16. A pipe handling system comprising:

a pipe delivery system comprising a trough adapted for receiving a tubular;

a plurality of pipe movement systems, each located adjacent or proximal the pipe delivery system, wherein each of the pipe movement systems comprises:

means for storing a plurality of tubulars;

means for lifting one of the plurality of tubulars from the means for storing a plurality of tubulars to a first position; and means for moving the one of the plurality of tubulars located in the first position longitudinally, wherein the means for lifting one of the plurality of tubulars is adapted to move the one of the plurality of tubulars from the first position to a second position from which the tubular will roll into the trough.

17. The pipe handling system according to claim 16, wherein the means for storing the plurality of tubulars comprises a plurality of beams extending outwardly from the pipe delivery system.

18. The pipe handling system according to claim 16, wherein the means for lifting one of the plurality of tubulars comprises a plurality of lifting arms adapted to move from a first position to a second position in response to a user command therefor.

19. The pipe handling system according to claim 17, wherein the means for moving the one of the plurality of tubulars longitudinally comprises a plurality of rollers adapted to rotate while the one of the plurality of tubulars is resting thereon.

20. A method of drilling a well, the method comprising:

(a) providing a trough for receiving a drill pipe therein and moving the pipe from the trough to a location above a rig floor of a drilling rig coupled to a drill string and drilling a well;

(b) providing a pipe rack having a plurality of drill pipes thereon;

(c) providing a pipe handling apparatus adjacent or proximal to the pipe rack, wherein the pipe handling apparatus comprises means for receiving a pipe from the pipe rack and lifting the pipe to move the pipe to the trough;

(d) using the pipe handling assembly to move a first pipe from the pipe rack to the trough;

(e) moving the pipe from the trough to the location above the rig floor;

(f) adding the pipe to the drill string; and (g) repeating steps (d)-(f) a plurality of times during drilling of the well.

21. A tubular handling apparatus comprising:

a plurality of pipe beams defining a pipe rack;

a plurality of tiering arms, each having a first recess; and a plurality of lifting arms, each lifting arm corresponding to one of the plurality of tiering arms, and each lifting arm having a second recess proximate a first end of each of the lifting arms, wherein each second recess is aligned with a first recess of a corresponding tiering arm, the plurality of lifting arms being actuatable between a raised position and a lowered position relative to the plurality of tiering arms, wherein a top surface of each of the plurality of pipe beams comprises a slope extending downward towards the plurality of tiering arms;

a plurality of rollers positioned within each of the tiering arms for engaging with and moving a tubular positioned within the first recess of the tiering arms.

22. The tubular handling apparatus of claim 21, further comprising:

a plurality of pipe sizers that are movable and adapted to accommodate a plurality of tubular sizes.

23. The tubular handling apparatus of claim 21, wherein each lifting arm of the plurality of lifting arms comprises a third recess proximate a second end of the lifting arm.

24. The tubular handling apparatus of claim 23, wherein each lifting arm of the plurality of lifting arms comprises an angled rear end region adapted to block a tubular from rolling off the rear end region.

25. The tubular handling apparatus of claim 21, further comprising:

at least one hydraulic cylinder coupled to the plurality of lifting arms for actuating the lifting arms from their respective lowered positions to their respective raised positions.

26. The tubular handling apparatus of claim 21, further comprising a stopper plate having a moving block coupled to at least one spring, the moving block movable within a slot in a housing plate and adapted to block a tubular from rolling beneath the tiering arm.

27. The tubular handling apparatus of claim 21, wherein the plurality of tiering arms are actuatable between an elevated position and a lowered position.

28. The tubular handling apparatus of claim 21, wherein the apparatus is adapted to be placed adjacent or near to a pipe delivery system for a drilling rig, wherein the pipe delivery system comprises a trough and the apparatus is adapted to lift a tubular from a first position resting on the plurality of pipe beams or one or more tubulars resting on the plurality of pipe beams to a second position, from which the tubular rolls into the trough of the pipe delivery system.

29. The tubular handling apparatus of claim 21, further comprising a control system for controlling movement of the tiering arms and/or the lifting arms.

30. The tubular handling apparatus of claim 29, wherein the control system is adapted to move the tiering and/or the lifting arms in response to a user command therefor.

31. The tubular handling apparatus of claim 30, wherein the control system is coupled to a user control device by a wired or wireless coupling.

* * * * *